US007825318B2

(12) United States Patent
Ito

(10) Patent No.: US 7,825,318 B2
(45) Date of Patent: Nov. 2, 2010

(54) DRUMHEAD TIGHTENING DEVICE, SUPPORT DEVICE FOR DRUM INCLUDING THE DRUMHEAD TIGHTENING DEVICE, AND DRUM

(75) Inventor: Fusamitsu Ito, Seto (JP)

(73) Assignee: Hoshino Gakki Co., Ltd. (JP)

( * ) Notice: Subject to any disclaimer, the term of this patent is extended or adjusted under 35 U.S.C. 154(b) by 78 days.

(21) Appl. No.: 12/209,299

(22) Filed: Sep. 12, 2008

(65) Prior Publication Data

US 2009/0282964 A1 Nov. 19, 2009

(30) Foreign Application Priority Data

May 13, 2008 (JP) ..... 2008-126105

(51) Int. Cl.
*G10D 13/02* (2006.01)

(52) U.S. Cl. ..... 84/411 R

(58) Field of Classification Search ..... 84/411 R, 84/413

See application file for complete search history.

(56) References Cited

U.S. PATENT DOCUMENTS

| | | | | |
|---|---|---|---|---|
| 1,853,466 | A * | 4/1932 | Sigler | 84/415 |
| 3,533,324 | A | 10/1970 | Price | |
| 4,583,442 | A | 4/1986 | Minor | |
| 4,693,163 | A | 9/1987 | Hsieh | |
| 5,309,811 | A | 5/1994 | Hoshino | 84/421 |
| 5,561,255 | A | 10/1996 | Sassmannshausen et al. | 84/413 |
| 6,107,555 | A | 8/2000 | Hoshino | 84/421 |
| 7,307,204 | B2 | 12/2007 | Ito | 84/411 |

FOREIGN PATENT DOCUMENTS

| | | |
|---|---|---|
| JP | 55-77287 | 5/1980 |
| JP | 59-1260 | 1/1984 |
| JP | 60-90497 | 6/1985 |
| JP | 5-127669 | 5/1993 |
| JP | 7-77214 | 3/1995 |
| JP | 7-508602 | 9/1995 |
| JP | 11-161265 | 6/1999 |
| JP | 2002-156965 | 5/2002 |
| JP | 2006-58849 | 3/2006 |
| JP | 2004-151701 | 5/2007 |

OTHER PUBLICATIONS

Japanese Office Action, dated May 11, 2010, issued in corresponding Japanese Patent Application No. 2008-126105, total 2 pages.

* cited by examiner

*Primary Examiner*—Kimberly R Lockett
(74) *Attorney, Agent, or Firm*—Ostrolenk Faber LLP

(57) ABSTRACT

Drumhead tightening devices include lugs secured to a shell of a drum, lug bolts screwed to the lugs, hooks, which are engaged with a hoop fitted to an open end of the shell, and retaining members for retaining the position of the hooks with respect to the lug bolts. Each retaining member is mounted on one of the lug bolts in a state where the associated hook is arranged between a head portion of the lug bolt and the retaining member.

11 Claims, 6 Drawing Sheets

DRUMHEAD TIGHTENING DEVICE, SUPPORT DEVICE FOR DRUM INCLUDING THE DRUMHEAD TIGHTENING DEVICE, AND DRUM

BACKGROUND OF THE INVENTION

The present invention relates to a drumhead tightening device, a support device for drum including the drumhead tightening device, and a drum.

A typical drum includes a cylindrical shell, a drumhead, which closes an open end of the shell, a hoop fitted to the open end of the shell, and lugs provided on the outer circumferential surface of the shell. The drumhead is mounted on the shell via the hoop by screwing lug bolts into the lugs. Thus, when replacing the drumhead, all the lug bolts need to be loosened and removed from the lugs, and all the lug bolts need to be tightened to the lugs again. Therefore, replacing the drumhead is very cumbersome and time-consuming. Thus, for example, as disclosed in Patent Documents 1 to 5, devices have been proposed that permit replacing the drumhead without removing the lug bolts from the lug nuts. For example, Japanese Laid-Open Patent Publication No. 2004-151710, U.S. Pat. No. 4,693,163, and U.S. Pat. No. 3,533,324 each disclose a device that includes base portions, which are provided on the outer circumferential surface of the shell, and lugs, which are detachably mounted on the base portions. Also, Japanese Examined Utility Model Publication No. 59-1260 and U.S. Pat. No. 4,583,442 each disclose a device that includes lugs and lug bolts, which are provided on the outer circumferential surface of the shell, and hooks, which are provided at the head portions of the lug bolts and are engaged with the hoop.

However, according to the devices disclosed in Japanese Laid-Open Patent Publication No. 2004-151710, U.S. Pat. No. 4,693,163, and U.S. Pat. No. 3,533,324, when replacing the drumhead, the lug bolts and the nuts are hung from the hoop. In this case, since the lug bolts and the lug nuts of the hoop detached from the shell interfere with each other, it is difficult to place the hoop on the floor surface or on a table. Also, when mounting the drumhead, the lug bolts and the lug nuts that are hung from the hoop might damage the head surface of the drumhead and the circumferential surface of the shell. Furthermore, it takes a lot of time to couple all the lug nuts to the base portions of the shell. According to the devices disclosed in Japanese Examined Utility Model Publication No. 59-1260 and U.S. Pat. No. 4,583,442, since the hooks that are engaged with the hoop are provided on the lug bolts, the drumhead is easily mounted on and dismounted from the shell. However, according to the devices disclosed in the above publications, when engaging the hooks with the hoop, the hooks slide down with respect to the lug bolts, and it still takes a lot of time to temporarily tighten the lug bolts.

SUMMARY OF THE INVENTION

Accordingly, it is an objective of the present invention to provide a drumhead tightening device that permits a drumhead to be easily replaced, a support device for drum including the drumhead tightening device, and a drum.

To achieve the foregoing objective and in accordance with a first aspect of the present invention, a drumhead tightening device including a lug secured to a shell of a drum, a lug bolt screwed to the lug, and a hook, which is located at a head portion of the lug bolt and is engaged with a hoop fitted to an open end of the shell, is provided. When the hook is engaged with the hoop and the lug bolt is tightened to the lug, the drumhead, which closes the open end of the shell, is mounted on the shell via the hoop. The drumhead tightening device includes a retaining member, which is mounted on the lug bolt and retains the position of the hook with respect to the lug bolt. The retaining member is mounted on the lug bolt in a state where the hook is arranged between the head portion of the lug bolt and the retaining member.

In accordance with a second aspect of the present invention, a support device for drum utilizing a plurality of the drumhead tightening devices according to the first aspect is provided, in which the lug bolt is rotatably mounted on the lug such that the hook selectively approaches and separates from the hoop. The support device includes the drumhead tightening devices being provided on an outer circumferential surface of the shell, an arm coupled to the drumhead tightening devices, and a shaft, which supports the drum via the arm. Each lug bolt is supported to be rotatable with respect to the associated lug together with a lug nut. Each lug nut extends along the rotational axis of the lug nut. At least one end of each lug nut projects from a side surface of the associated lug. A rubber isolator is mounted on the end of each lug nut that projects from the associated lug. The arm is coupled to the drumhead tightening devices via the rubber isolators.

In accordance with a third embodiment of the present invention, a drum including a cylindrical shell, a pair of drumheads, which close upper and lower open ends of the shell, lugs secured to the shell, lug bolts screwed to the lugs, and hooks provided at head portions of the lug bolts and engaged with hoops fitted to the open ends of the shell is provided. When the hooks are engaged with the hoops and the lug bolts are tightened to the lugs, the drumheads are mounted on the shell via the hoops. The drum includes retaining members each mounted on one of the lug bolts and retains the position of the associated hook with respect to the lug bolt. Each retaining member is mounted on the associated lug bolt in a state where the associated hook is arranged between the head portion of the lug bolt and the retaining member.

DETAILED DESCRIPTION OF THE PREFERRED EMBODIMENT

A drumhead tightening device according to one embodiment of the present invention will now be described with reference to FIGS. 1 to 7.

Figure 1:
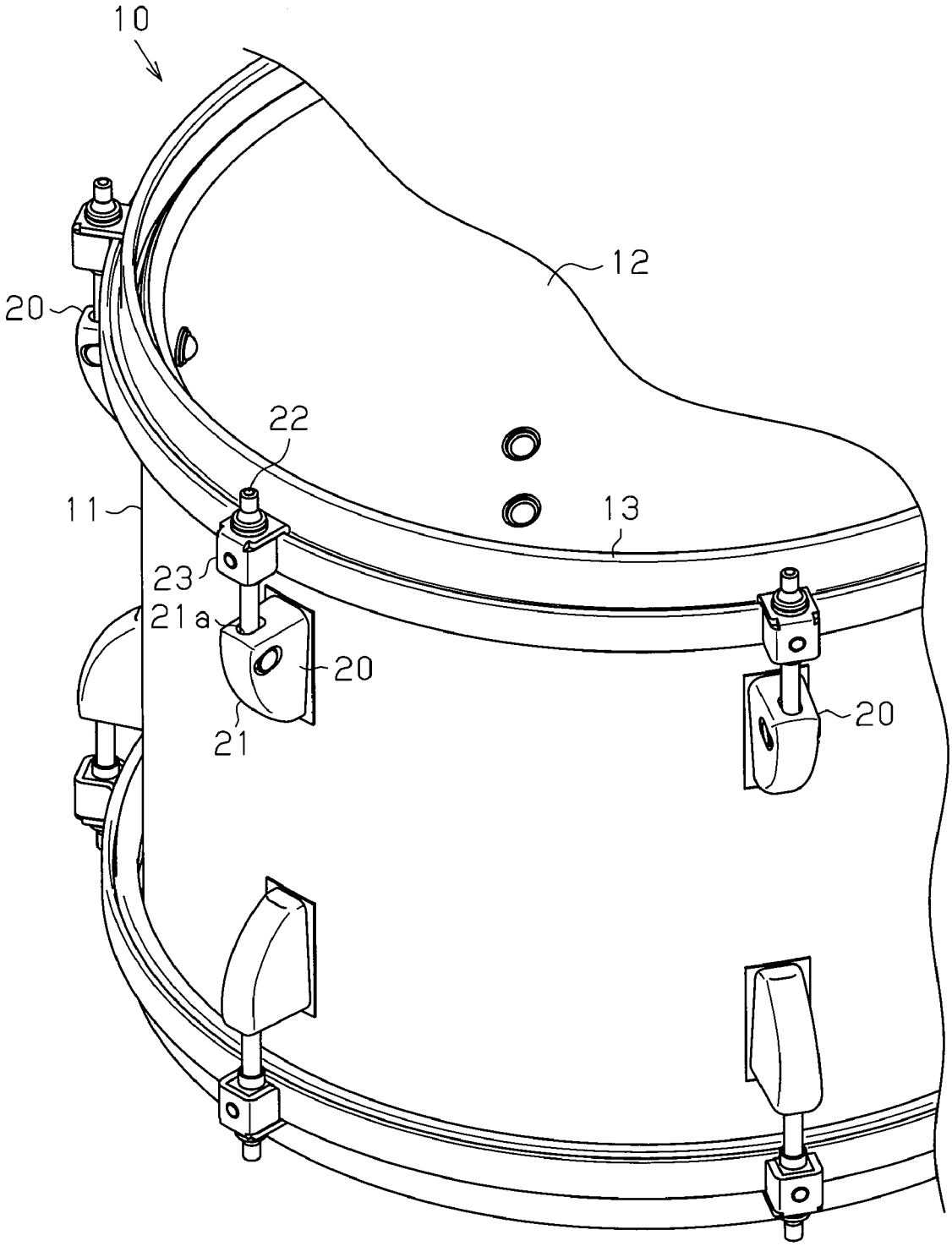
FIG. 1 is a partial perspective view illustrating a drum to which drumhead tightening devices according to a preferred embodiment are applied.

As shown in FIG. 1, a drum 10 includes a cylindrical shell 11, a drumhead 12, which closes an open end of the shell 11, a hoop 13 fitted to the open end of the shell 11, and drumhead tightening devices 20. The drumhead tightening devices 20 are arranged at equal intervals on the outer circumferential surface of the shell 11. The drumhead 12 is tightened to the open end of the shell 11 via the hoop 13 by the drumhead tightening devices 20. By manipulating the drumhead tightening devices 20, the tension of the drumhead 12 is changed, and the sound tone of the drum 10 is adjusted.

Figure 4A:
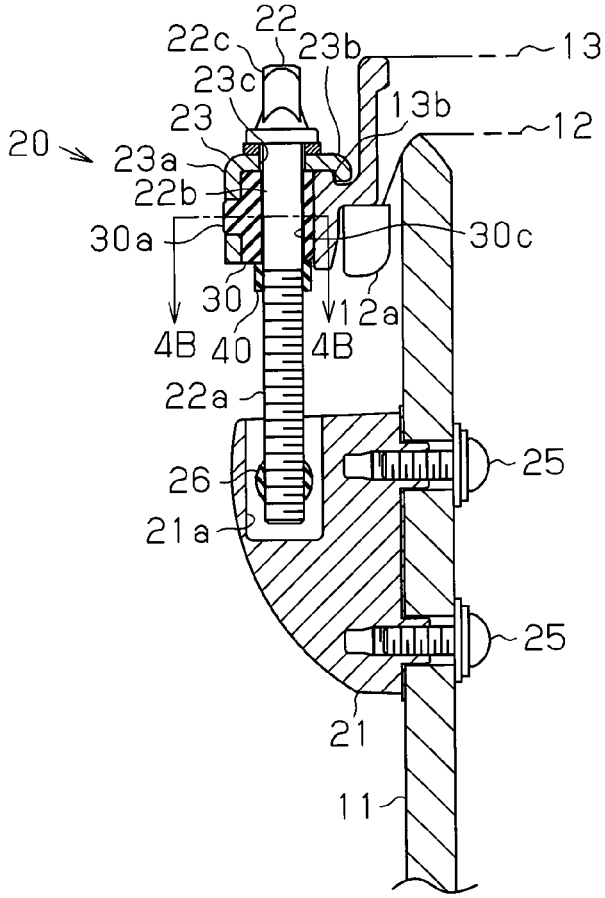
FIG. 4A is a longitudinal cross-sectional view illustrating one of the drumhead tightening devices in a state where the associated hook is engaged with the hoop.

As shown in FIGS. 1 and 4A, each drumhead tightening device 20 includes a lug 21, which is fixed to the outer circumferential surface of the shell 11, a lug bolt 22, which is tightened to the lug 21, and a hook 23, which is engaged with the hoop 13. The lug 21 is made of metal, and is formed into a substantially rectangular parallelepiped extending in the vertical direction. The lug 21 is fixed to the outer circumferential surface of the shell 11 by two bolts 25 from the inside of the shell 11. The lug 21 has an arrangement bore 21*a*, in which the lower end of the lug bolt 22 is arranged. The arrangement bore 21*a* extends downward from the upper surface of the lug 21. Also, the arrangement bore 21*a* extends along the rotation direction of the lug bolt 22 to permit rotation of the lug bolt 22 in the arrangement bore 21*a*.

Figure 2:
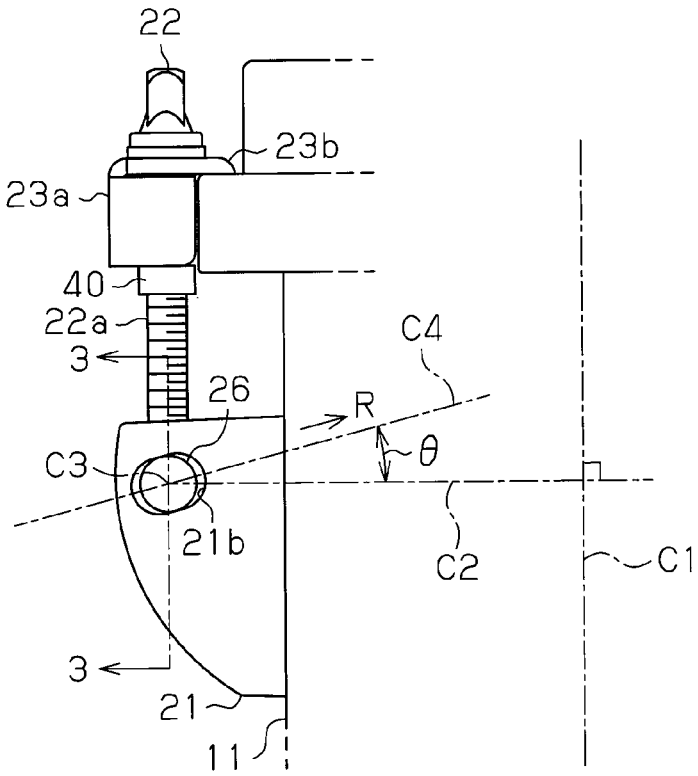
FIG. 2 is a side view illustrating one of the drumhead tightening devices.
Figure 3:
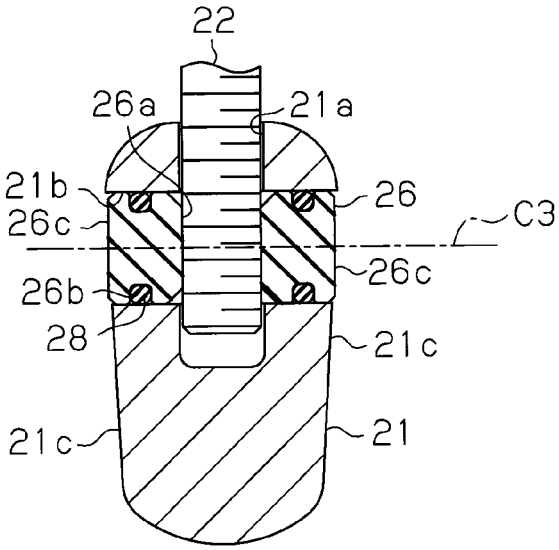
FIG. 3 is a partial cross-sectional view taken along line 3-3 of FIG. 2.

As shown in FIGS. 2 and 3, each lug 21 has a support recess, which is a horizontal bore 21*b* in this embodiment. The horizontal bore 21*b* extends from one to the other of the side surfaces of the lug 21. The horizontal bore 21*b* extends toward the open end of the shell 11. Also, the horizontal bore 21*b* is inclined toward the open end of the shell 11. The inclination angle θ of the horizontal bore 21*b* with respect to a horizontal line C2 shown in FIG. 2 is in the range of 10° to 20°, and is preferably set to 15°. The horizontal line C2 is a straight line that is orthogonal to an axis C3 of the horizontal bore 21*b* and axis C1 of the shell 11.

The horizontal bore 21*b* of each lug 21 supports a columnar lug nut 26 to be rotatable about its axis. Also, the lug nut 26 is supported to be movable toward the open end of the shell 11 in the horizontal bore 21*b* of the lug 21. End surfaces 26*c* of each lug nut 26 are substantially flush with side surfaces 21*c* of the associated lug 21. A threaded bore 26*a*, which is threadedly engaged with the lower end of the lug bolt 22, is formed at the center of each lug nut 26. Also, an annular groove 26*b*, which extends along the outer circumferential surface of the lug nut 26, is provided at each end of the lug nut 26. Holding means, which is an O-ring 28 in this embodiment, is provided in each groove 26*b* of the lug nut 26. The lug nut 26 is supported in a state where the O-rings 28 are in close contact with the inner circumferential surface of the horizontal bore 21*b*.

Figure 4B:
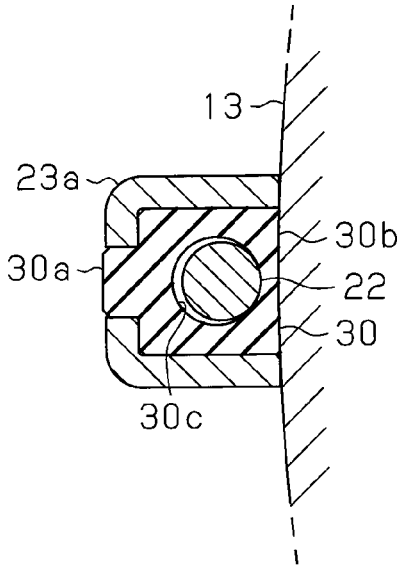
FIG. 4B is a transverse cross-sectional view taken along line 4B-4B of FIG. 4A.
Figure 5A:
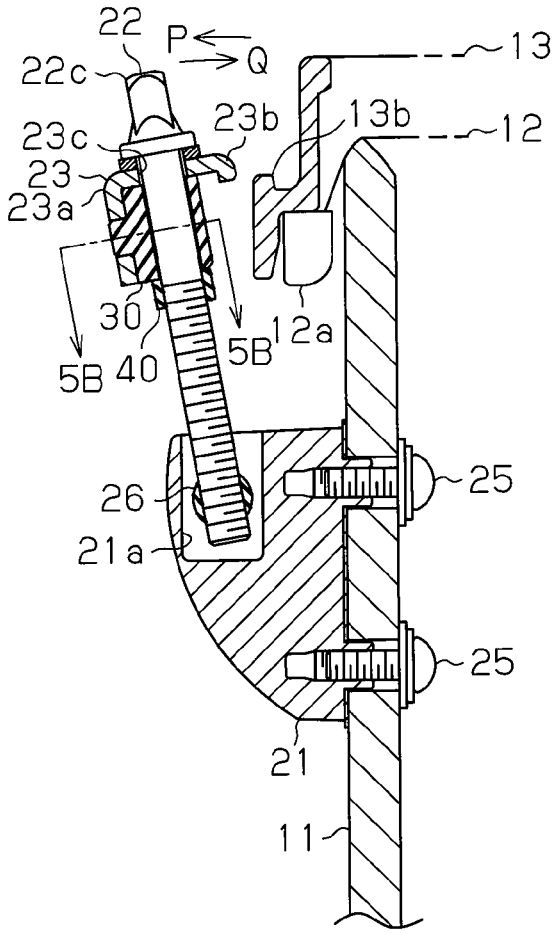
FIG. 5A is a longitudinal cross-sectional view illustrating one of the drumhead tightening devices in a state where the associated hook is disengaged from the hoop.

As shown in FIGS. 4 and 5, each lug bolt 22 includes a threaded portion 22*a*, which is screwed to the associated lug nut 26, a mounting portion 22*b*, to which the associated hook 23 is attached, and a head portion 22*c*, which is grasped by a tool such as a torque wrench. Each lug bolt 22 is rotatably mounted on the associated lug 21 via the associated lug nut 26. Each lug bolt 22 is selectively arranged at a first position, at which the associated hook 23 is engaged with the hoop 13, and a second position, at which the associated hook 23 is separated from the hoop 13, by rotating the lug bolt 22 about the axis C3 of the associated lug nut 26 (see FIG. 3). At the first position, each lug bolt 22 is supported in a state where the lug bolt 22 is upright with respect to the associated lug 21 as shown in FIG. 4A. At the second position, each lug bolt 22 is supported in a state where the lug bolt 22 is inclined with respect to the associated lug 21 as shown in FIG. 5A. Also, each lug bolt 22 is supported by the lug nut 26 to be movable toward the open end of the shell 11.

Each hook 23 is configured by a substantially box-like case portion 23*a* and a claw portion 23*b*. The lower surface of the case portion 23*a* and the inner side surface of the case portion 23*a* facing the hoop 13 are open. The claw portion 23*b* is formed on the upper wall of the case portion 23*a*. The claw portion 23*b* of the hook 23 is engaged with an engaged portion 13*b*, which is formed on the outer circumferential surface of the hoop 13. The claw portion 23*b* is formed by bending the inner edge of the upper wall of the case portion 23*a* downward. The upper wall of the case portion 23*a* is provided with a through hole 23*c* through which the associated lug bolt 22 is loosely inserted.

Figure 5B:
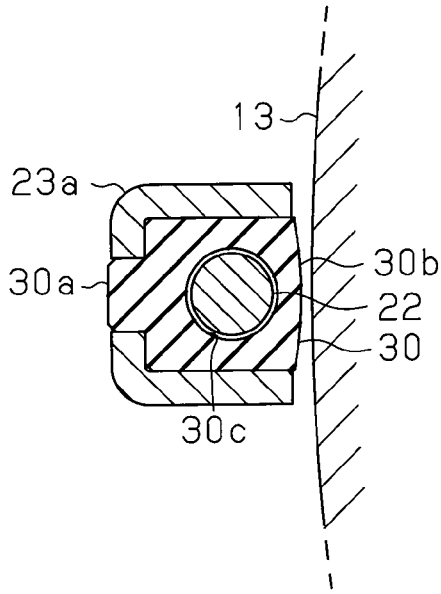
FIG. 5B is a transverse cross-sectional view taken along 5B-5B of FIG. 5A.

An elastic member, which is a locking member 30 made of a rubber piece in this embodiment, is provided in each case portion 23*a*. The locking member 30 has a protrusion 30*a* on its outer side surface. The protrusion 30*a* of the locking member 30 is inserted in a hole of the case portion 23*a*, so that the locking member 30 is prevented from falling off the case portion 23*a*. The locking member 30 has a through hole 30*c* at a position corresponding to the through hole 23*c* of the hook 23. The lug bolt 22 is loosely inserted in the through hole 30*c*. The inner diameter of the through hole 30*c* of the locking member 30 is set greater than the cross-sectional diameter of the mounting portion 22*b* of the lug bolt 22. Also, as shown in FIG. 5B, the locking member 30 has a contact surface 30*b*, which contacts the outer circumferential surface of the hoop 13. The contact surface 30*b* of the locking member 30 bulges toward the outer circumferential surface of the hoop 13. The contact surface 30*b* of the locking member 30 is a surface smoothly curved along an arc.

As shown in FIGS. 5A and 5B, each lug bolt 22 is loosely inserted in the through hole 23*c* of the associated hook 23 and the through hole 30*c* of the associated locking member 30. In the present embodiment, each drumhead tightening device 20 includes a retaining member 40 for retaining the position of the hook 23 with respect to the lug bolt 22. The retaining member 40 is mounted on the threaded portion 22*a* of the lug bolt 22 in a state where the hook 23 and the locking member 30 are arranged between the head portion 22*c* of the lug bolt 22 and the retaining member 40. More specifically, the retaining member 40 is mounted in a state where the hook 23 is arranged between the head portion 22*c* of the lug bolt 22 and the retaining member 40, and the locking member 30 is arranged between the hook 23 and the retaining member 40. That is, the retaining member 40 is mounted so as to support the hook 23 and the locking member 30 from below. The retaining member 40 is made of an elastic member, which is a rubber piece in this embodiment, and formed into a ring shape. The retaining member 40 is in close contact with the outer circumferential surface of the lug bolt 22 by elastic force of the retaining member 40.

Next, the operation of the drumhead tightening devices 20 will now be described with reference to FIGS. 2, 4 and 5. The manipulation for removing the drumhead 12 from the shell 11 to replace the drumhead 12 will be discussed below.

First, all the lug bolts 22 are loosened using a tool from a state where the lug bolts 22 are tightened to the lug nuts 26 as shown in FIG. 4A. Thus, the lug bolts 22 move upward with respect to the lug nuts 26, and the hooks 23 supported by the retaining members 40 also move upward with the lug bolts 22. When each lug bolt 22 moves upward by a predetermined amount or more, the claw portion 23*b* of the associated hook 23 is disengaged from the engaged portion 13*b* of the hoop 13. Thereafter, as shown in FIG. 5A, the lug bolts 22 are rotated outward (direction P shown in FIG. 5A), so that the claw portion 23*b* of each hook 23 is separated from the engaged portion 13*b* of the hoop 13. At this time also, the retaining members 40 mounted on the lug bolts 22 retain the hooks 23 so as not to slide down with respect to the lug bolts 22. In this state, the hoop 13 is removed from a head frame 12*a* of the drumhead 12, and the drumhead 12 is removed from the open end of the shell 11.

The manipulation for mounting the drumhead 12 on the shell 11 will now be described. The drumhead 12 is arranged to close the open end of the shell 11. Then, the hoop 13 is fitted to the drumhead 12 from above such that the lower surface of the hoop 13 abuts against the upper surface of the head frame 12*a*. Subsequently, the lug bolts 22 are rotated inward (direction Q in FIG. 5A), so that the claw portions 23*b* of the hooks 23 are moved to positions immediately above the engaged portion 13*b* of the hoop 13. In this state, each lug bolt 22 is retained in a state where a gap is formed between the lug bolt 22 and the associated locking member 30 as shown in FIG. 5B. Thus, the lug bolts 22 can be tightened to the lug nuts 26 by turning the lug bolts 22 with hand.

After tightening the lug bolts 22 by a predetermined amount or more, the lug bolts 22 are tightened to the lug nuts 26 using a tool such as a torque wrench. By tightening each lug bolt 22, the associated hook 23 and the lug nut 26 approach each other. Thus, the lug bolt 22 moves downward with respect to the lug nut 26, and the hook 23 supported by the retaining member 40 also moves downward with the lug bolt 22. When each lug bolt 22 moves downward by a predetermined amount or more, the claw portion 23*b* of the associated hook 23 is engaged with the engaged portion 13*b* of the hoop 13 as shown in FIG. 4A. At this time, each lug nut 26 moves toward the axis C1 of the shell 11 in the horizontal bore 21*b* of the associated lug 21 shown in FIG. 2. More specifically, each lug nut 26 moves along a straight line C4, which is inclined with respect to the horizontal line C2 by the inclination angle θ, in the direction R shown in FIG. 2.

With such movement of the lug nuts 26, the lug bolts 22 and the hooks 23 move toward the axis C1 of the shell 11. Then, as shown in FIG. 4B, the contact surface 30*b* of each locking member 30 retained by the hook 23 abuts against the outer circumferential surface of the hoop 13. Thereafter, by further tightening each lug bolt 22, the contact surface 30*b* of the associated locking member 30 is pressed by the hoop 13 and is elastically deformed. Accompanying such elastic deformation of each locking member 30, the inner circumferential surface of the through hole 30*c* of the locking member 30 is pressed against the outer circumferential surface of the associated lug bolt 22, so that the outer circumferential surface of each lug bolt 22 and the inner circumferential surface of the through hole 30*c* closely contact each other. Thus, frictional force is generated between each lug bolt 22 and the associated locking member 30, and the frictional force prevents each lug bolt 22 from being loosened with respect to the associated lug nut 26.

The present embodiment has the following advantages.

(1) Each drumhead tightening device 20 includes the retaining member 40 for retaining the position of the hook 23 with respect to the associated lug bolt 22. Each retaining member 40 is mounted on the threaded portion 22*a* of the associated lug bolt 22 in a state where the associated hook 23 is arranged between the head portion 22*c* of the lug bolt 22 and the retaining member 40. With this configuration, even if the hooks 23 are removed from the hoop 13 to replace the drumhead 12, the retaining members 40 retain the hooks 23 so as not to slide down with respect to the lug bolts 22. Thus, the lug bolts 22 are temporarily tightened easily, and the drumhead 12 is replaced smoothly.

(2) The locking member 30 is provided in the case portion 23*a* of each hook 23. With this configuration, each locking member 30 retains the associated lug bolt 22 such that the lug bolt 22 does not loosen with respect to the lug 21. Thus, for example, the tension of the drumhead 12 is suppressed from being reduced while playing the drum 10.

(3) Each retaining member 40 is mounted in a state where the locking member 30 is arranged between the associated hook 23 and the retaining member 40. With this configuration, each retaining member 40 retains the locking member 30 with the hook 23 so as not to slide down with respect to the associated lug bolt 22.

(4) Each locking member 30 has the through hole 30*c* through which the associated lug bolt 22 is loosely inserted. With this configuration, each locking member 30 is elastically deformed, so that the lug bolt 22 and the inner circumferential surface of the through hole 30*c* are in close contact with each other. Thus, frictional force is generated between each lug bolt 22 and the associated locking member 30, and the lug bolt 22 is retained by the frictional force so as not to be loosened with respect to the associated lug 21.

(5) Each horizontal bore 21*b* extends toward the axis C1 of the shell 11. Each lug nut 26 is supported to be movable in the associated horizontal bore 21*b*. With this configuration, when tightening each lug bolt 22 to the associated lug 21, the position of the lug nut 26 in the horizontal bore 21*b* is adjusted. This suppresses partial contact between each hook 23 and the hoop 13 generated by dimension errors of the shell 11, the head frame 12*a*, and the hoop 13, and partial contact between each hook 23 and the associated lug bolt 22. Thus, the drum 10 is prevented from being damaged by excessively tightening the lug bolts 22.

(6) The horizontal bores 21*b* are inclined toward the open end of the shell 11. With this configuration, as each hook 23 and the associated lug nut 26 approach each other by tightening each lug bolt 22, the lug nut 26 smoothly moves toward the open end of the shell 11 in the associated horizontal bore 21*b*. That is, since each lug nut 26 smoothly moves in the associated horizontal bore 21*b*, the position of the lug nut 26 in the horizontal bore 21*b* is adjusted easily.

(7) The contact surface 30*b* of each locking member 30 bulges toward the outer circumferential surface of the hoop 13. With this configuration, the contact surface 30*b* of each locking member 30 has elasticity, and bulges toward the outer circumferential surface of the hoop 13. In this case, as each hook 23 approaches the axis C1 of the shell 11 by tightening the associated lug bolt 22, the contact surface 30*b* of the associated locking member 30 is pressed by the hoop 13 and is elastically deformed. As each locking member 30 is elastically deformed, the associated lug bolt 22 and the inner circumferential surface of the through hole 30*c* of the locking member 30 come into close contact with each other. Thus, frictional force is generated between each lug bolt 22 and the associated locking member 30, and the frictional force retains the lug bolt 22 so as not to be loosened with respect to the associated lug 21.

(8) The inner diameter of the through holes 30*c* of the locking members 30 is set greater than the cross-sectional diameter of the mounting portions 22*b* of the lug bolts 22.

With this configuration, immediately after starting to tighten each lug bolt 22, the lug bolt 22 can be turned by hand, so as to be tightened to the associated lug nut 26 since the lug bolt 22 is retained in a state loosely inserted in the through hole 30*c* of the associated locking member 30. When each lug bolt 22 is tightened with a tool after tightening the lug bolt 22 by a predetermined amount or more, the contact surface 30*b* of the associated locking member 30 is pressed by the hoop 13 and is elastically deformed. Thus, the inner circumferential surface of each through hole 30*c* is pressed against the outer circumferential surface of the associated lug bolt 22, thereby generating frictional force between each lug bolt 22 and the associated locking member 30. With the frictional force, each lug bolt 22 is retained so as not to be loosened with respect to the associated lug nut 26. With this procedure, the lug bolts 22 are temporarily tightened easily and in a short period of time, and thus the drumhead 12 is replaced more smoothly.

(9) Each lug bolt 22 is rotatably mounted on the associated lug 21 such that the associated hook 23 approaches or separates from the hoop 13. In this case, after detaching each hook 23 from the hoop 13, the hook 23 is separated from the hoop 13 by rotating each lug bolt 22 with respect to the associated lug 21. Thus, interference between the lug bolts 22 and the hoop 13 is avoided, permitting the hoop 13 to be easily removed from the shell 11.

(10) The grooves 26*b* of each lug nut 26 are each provided with the O-ring 28, which serves as retaining means. With this configuration, the O-rings 28 retain the rotational position of each lug bolt 22 with respect to the associated lug 21. Thus, even if the hooks 23 are detached from the hoop 13 for replacing the drumhead 12, the lug bolts 22 are retained so as not to fall inward. The interference between the lug bolts 22 and the hoop 13 is therefore avoided, permitting the hoop 13 to be easily mounted on the open end of the shell 11.

The preferred embodiment may be modified as follows.

Figure 6:
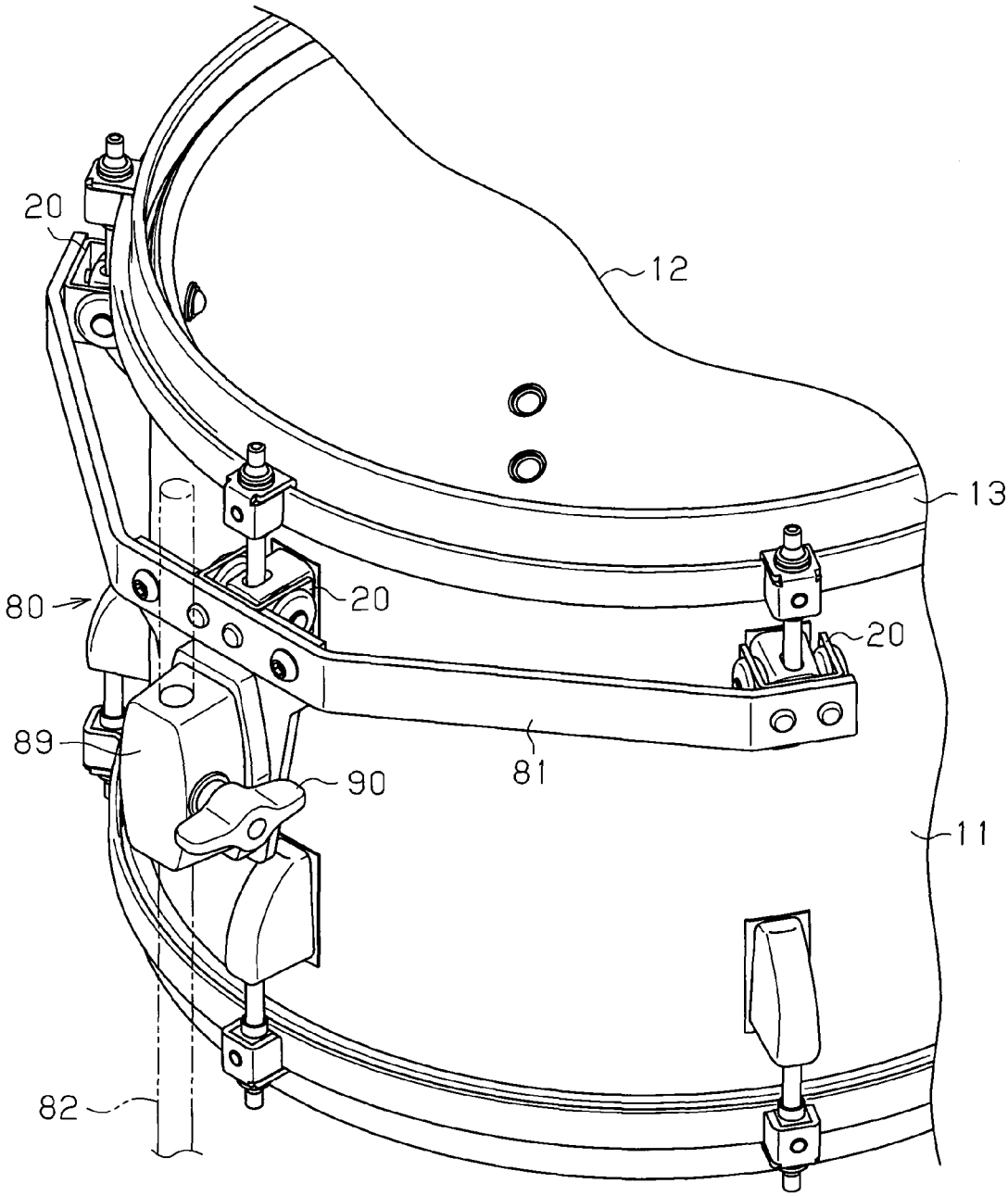
FIG. 6 is a perspective view illustrating a drum support system using the drumhead tightening devices of the preferred embodiment.
Figure 7:
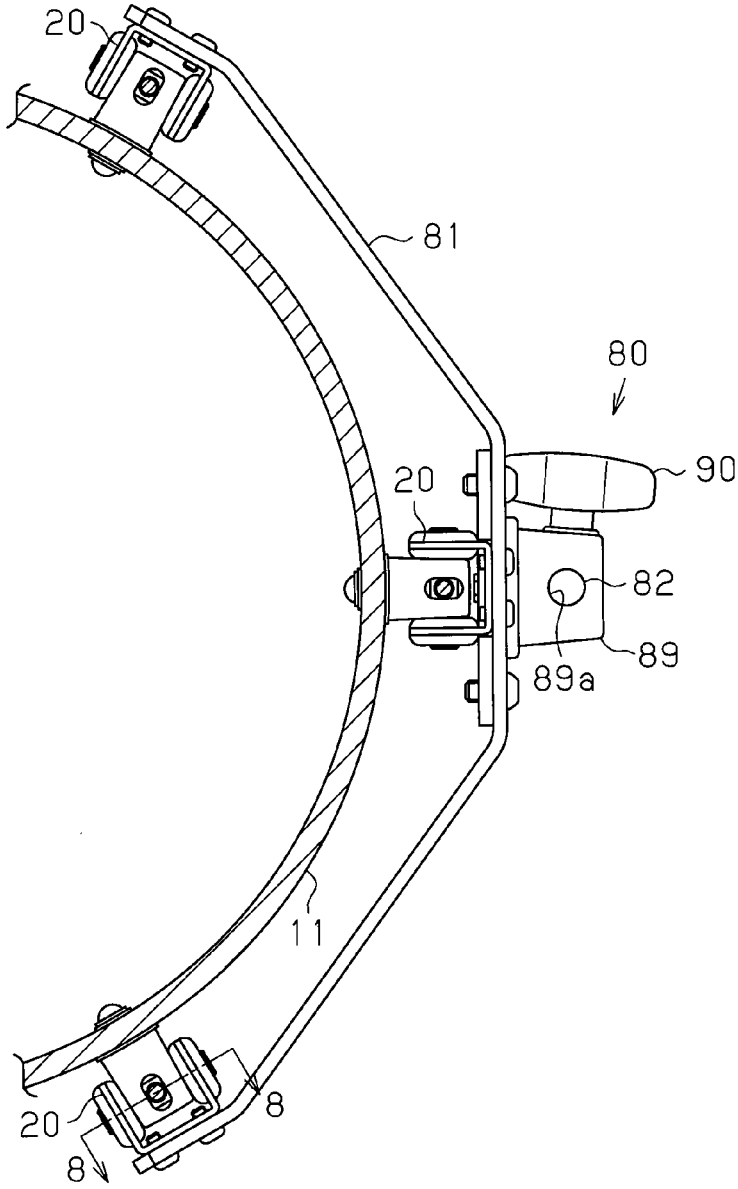
FIG. 7 is a top view illustrating the drumhead support system.
Figure 8:
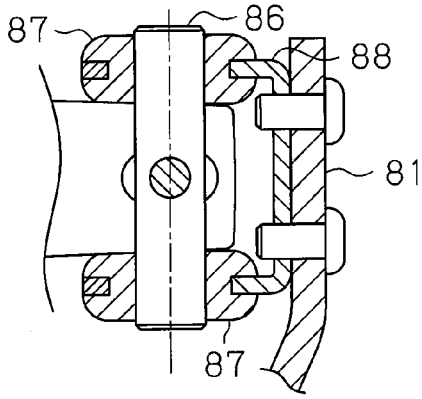
FIG. 8 is a partial cross-sectional view taken along line 8-8 of FIG. 7.

In the present embodiment, a support device of the drum 10 as shown in FIGS. 6 to 8 may be formed using the drumhead tightening devices 20. As shown in FIGS. 6 to 8, a drum support system 80, which serves as the support device, includes three drumhead tightening devices 20 provided on the shell 11, an arm 81, which is coupled to the shell 11 via the drumhead tightening devices 20, and a shaft 82, which supports the drum 10 via the arm 81. Each lug bolt 22 is supported to be rotatable with respect to the associated lug 21 together with a lug nut 86. Each lug nut 86 is formed into a columnar shape extending along the rotational axis of the lug nut 86. The ends of each lug nut 86 project outward from the side surfaces of the associated lug 21. Each drumhead tightening device 20 includes pair of rubber isolators 87, which are mounted on the ends of the lug nut 86. Three portions, that is, the end portions and the center portion of the arm 81 are coupled to the rubber isolators 87 of each drumhead tightening device 20 via a holder 88. A mounting fixture 89 to which the shaft 82 is mounted is provided at the center of the arm 81. The mounting fixture 89 is provided with a through hole 89*a* through which the shaft 82 is inserted and a fixing screw 90 for fixing the shaft 82 to the through hole 89*a*. By manipulating the fixing screw 90, the height of the drum 10 with respect to the shaft 82 is adjusted. With this configuration, the rubber isolators 87 mounted on the end portions of each lug nut 86 suppress leakage of vibration from the drum 10 to the drum support system 80, allowing the sound of the drum to resonate. Also, the drum support system 80 using the lug nuts 26 configuring the drumhead tightening devices 20 may be provided. In the example shown in FIGS. 6 to 8, the number of the drumhead tightening devices 20 coupled to the arm 81 may be two.

In the present embodiment, the locking members 30 may be omitted. In this case, by using the frictional force generated between each retaining member 40 and the associated lug bolt 22, the retaining members 40 may function as the locking members 30.

In the present embodiment, the locking members 30 may be formed by material other than rubber such as resin. Also, the retaining members 40 may be formed by material other than rubber such as resin, metal, or ceramics. Furthermore, as the retaining members 40, fasteners such as e-rings and nuts may be used.

In the present embodiment, the locking members 30 and the retaining members 40 are both made of rubber pieces, but are made separately. However, each retaining member 40 and the associated locking member 30 may be integrally formed of an elastic material such as rubber. In this case, the number of components of the entire drumhead tightening devices 20 is reduced, and thus suppresses increase in the number of assembly processes.

In the present embodiment, the shape of the contact surface 30*b* of each locking member 30 may be a flat surface, or a curved surface that is concave with respect to the hoop 13.

In the present embodiment, the diameter of the through holes 30*c* of the locking members 30 may be equal to or less than the cross-sectional diameter of the lug bolts 22.

In the present embodiment, the O-rings, which serve as the retaining means, may be omitted.

The invention claimed is:

1. A drumhead tightening device including a lug secured to a shell of a drum, a lug bolt screwed to the lug, and a hook, which is located at a head portion of the lug bolt and is engaged with a hoop fitted to an open end of the shell, wherein, when the hook is engaged with the hoop and the lug bolt is tightened to the lug, the drumhead, which closes the open end of the shell, is mounted on the shell via the hoop, the drumhead tightening device comprising:

a retaining member, which is mounted on the lug bolt and retains the position of the hook with respect to the lug bolt;

a locking member, which is mounted on the lug bolt and retains the lug bolt so as not to be loosened with respect to the lug, wherein the locking member is formed of an elastic member having a through hole through which the lug bolt is inserted, and wherein the retaining member is mounted on the lug bolt in a state where the hook is arranged between the head portion of the lug bolt and the retaining member.

2. The drumhead tightening device according to claim 1, wherein the retaining member is mounted on the lug bolt in a state where the locking member is arranged between the hook and the retaining member.

3. The drumhead tightening device according to claim 1, wherein the retaining member is formed of an elastic member.

4. A drumhead tightening device including a lug secured to a shell of a drum, a lug bolt screwed to the lug, and a hook, which is located at a head portion of the lug bolt and is engaged with a hoop fitted to an open end of the shell, wherein, when the hook is engaged with the hoop and the lug bolt is tightened to the lug, the drumhead, which closes the open end of the shell, is mounted on the shell via the hoop, the drumhead tightening device comprising:

a retaining member, which is mounted on the lug bolt and retains the position of the hook with respect to the lug bolt, wherein the retaining member is mounted on the lug bolt in a state where the hook is arranged between the head portion of the lug bolt and the retaining member, wherein the lug includes a lug nut to which the lug bolt is screwed, wherein the lug is provided with a support recess by which the lug nut is supported, wherein the support recess extends toward the axis of the shell, and wherein the lug nut is supported to be movable in the support recess.

5. The drumhead tightening device according to claim 4, wherein the support recess is inclined toward the open end of the shell.

6. The drumhead tightening device according to claim 5, wherein the locking member has a contact surface, which abuts against an outer circumferential surface of the hoop, and wherein the contact surface bulges toward the outer circumferential surface of the hoop.

7. The drumhead tightening device according to claim 6, wherein the inner diameter of the through hole of the locking member is set greater than the cross-sectional diameter of the lug bolt.

8. A drumhead tightening device including a lug secured to a shell of a drum, a lug bolt screwed to the lug, and a hook, which is located at a head portion of the lug bolt and is engaged with a hoop fitted to an open end of the shell, wherein, when the hook is engaged with the hoop and the lug bolt is tightened to the lug, the drumhead, which closes the open end of the shell, is mounted on the shell via the hoop, the drumhead tightening device comprising:

a retaining member, which is mounted on the lug bolt and retains the position of the hook with respect to the lug bolt, wherein the retaining member is mounted on the lug bolt in a state where the hook is arranged between the head portion of the lug bolt and the retaining member, wherein the lug bolt is rotatably mounted on the lug such that the hook selectively approaches and separates from the hoop.

9. The drumhead tightening device according to claim 8, further comprising:

retaining means for retaining the rotational position of the lug bolt with respect to the lug.

10. A support device for drum utilizing a plurality of the drumhead tightening devices according to claim 8, comprising:

the drumhead tightening devices being provided on an outer circumferential surface of the shell;

an arm coupled to the drumhead tightening devices; and a shaft, which supports the drum via the arm, wherein each lug bolt is supported to be rotatable with respect to the associated lug together with a lug nut, wherein each lug nut extends along the rotational axis of the lug nut, wherein at least one end of each lug nut projects from a side surface of the associated lug, wherein a rubber isolator is mounted on the end of each lug nut that projects from the associated lug, and wherein the arm is coupled to the drumhead tightening devices via the rubber isolators.

11. A drum including a cylindrical shell, a pair of drumheads, which close upper and lower open ends of the shell, lugs secured to the shell, lug bolts screwed to the lugs, and hooks provided at head portions of the lug bolts and engaged with hoops fitted to the open ends of the shell, wherein, when the hooks are engaged with the hoops and the lug bolts are tightened to the lugs, the drumheads are mounted on the shell via the hoops, the drum comprising:

retaining members each mounted on one of the lug bolts and retains the position of the associated hook with respect to the lug bolt;

locking members each mounted on one of the lug bolts and retaining the lug bolts so as not to be loosened with respect to the lugs, wherein each locking member is formed of an elastic member having a through hole through which the lug bolt is inserted; and wherein each retaining member is mounted on the associated lug bolt in a state where the associated hook is arranged between the head portion of the lug bolt and the retaining member.

* * * * *